United States Patent [19]

Gaskell

[11] Patent Number: 4,552,310

[45] Date of Patent: Nov. 12, 1985

[54] FUEL INJECTION NOZZLES

[75] Inventor: David J. Gaskell, Sudbury, England

[73] Assignee: Lucas Industries public limited company, Birmingham, England

[21] Appl. No.: 626,070

[22] Filed: Jun. 29, 1984

[30] Foreign Application Priority Data

Jul. 16, 1983 [GB] United Kingdom ..... 8319284

[51] Int. Cl.[4] ..... F02M 47/06

[52] U.S. Cl. ..... 239/533.5

[58] Field of Search ..... 239/533.2–533.12, 239/584

[56] References Cited

U.S. PATENT DOCUMENTS 3,403,861 10/1968 Eidtmann et al. ..... 239/533.5

*Primary Examiner*—Andres Kashnikow

[57] ABSTRACT

A fuel injection nozzle of the inwardly opening type has a valve member which is slidable within a bore to control fuel flow through an outlet. Fuel under pressure from an inlet is supplied to an enlargement to act upon the valve member to lift the valve member against spring pressure and the fuel can flow to the enlargement by way of two flow paths the first of which includes a groove on the valve member and a first port in the wall of the bore. The port is positioned so that increasing restriction to the flow of fuel to the outlet occurs as the valve member lifts. The second flow path includes the groove and a second port which opens to the groove after a predetermined movement of the valve member. The initial movement of the valve member under the action of increasing fuel pressure at the inlet is thus controlled.

4 Claims, 2 Drawing Figures

FUEL INJECTION NOZZLES

This invention relates to fuel injection nozzles of the so-called inwardly opening type and comprising a nozzle body, a blind bore formed in the body, a seating defined at the blind end of the bore, a valve member slidable in the bore, one end of the valve member being shaped to co-operate with said seating, resilient means for biasing the valve member into contact with the seating, a fuel inlet in the body, and said valve member defining an area against which fuel under pressure supplied to said inlet can act to lift the valve member away from the seating thereby to allow fuel flow through an outlet.

In the use of such a nozzle the aforesaid fuel inlet is connected to the or an outlet of an injection pump which delivers fuel at high pressure. It is desirable for most engines that the initial rate of fuel delivery to the engine should be at a low rate in order to minimise rapid increases of pressure in the combustion chamber. Most injection pumps however have too high a rate of pressure rise at the commencement of fuel delivery and the practical effect is that the valve member is quickly lifted from its seating to allow a high rate of delivery of fuel to the associated combustion chamber. Even if the nozzle does incorporate means on the valve member which adjust the effective size of the outlet to try to achieve a measure of control over the initial rate of fuel delivery, the effect of the means is largely lost if the valve member opens too quickly.

The object of the present invention is to provide a fuel invention nozzle of the kind specified in a simple and convenient form.

According to the invention a fuel injection nozzle of the kind specified includes first and second flow paths through which fuel flows from said inlet to act upon said area of the valve member and to said outlet, said first flow path including a restrictor the degree of restriction offered by the restrictor increasing as the valve member moves away from the seating, said second flow path being closed when the valve member is in contact with the seating but opening when the valve member has moved a predetermined distance away from the seating, said second flow path when opened, offering decreasing restriction to the flow of fuel as the valve member continues to move away from the seating.

Figure 1:
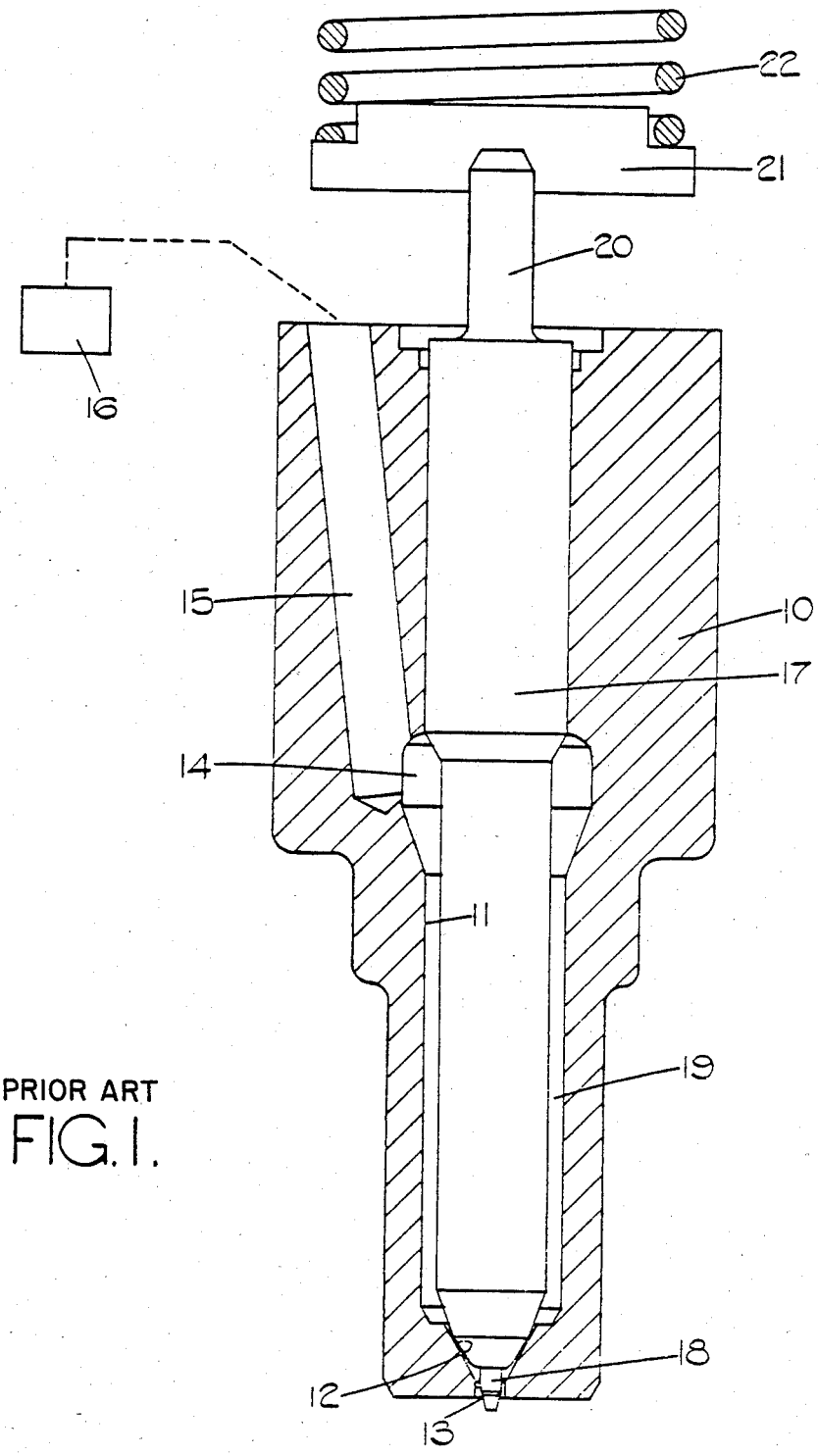
PRIOR ART FIG. 1.
Figure 2:
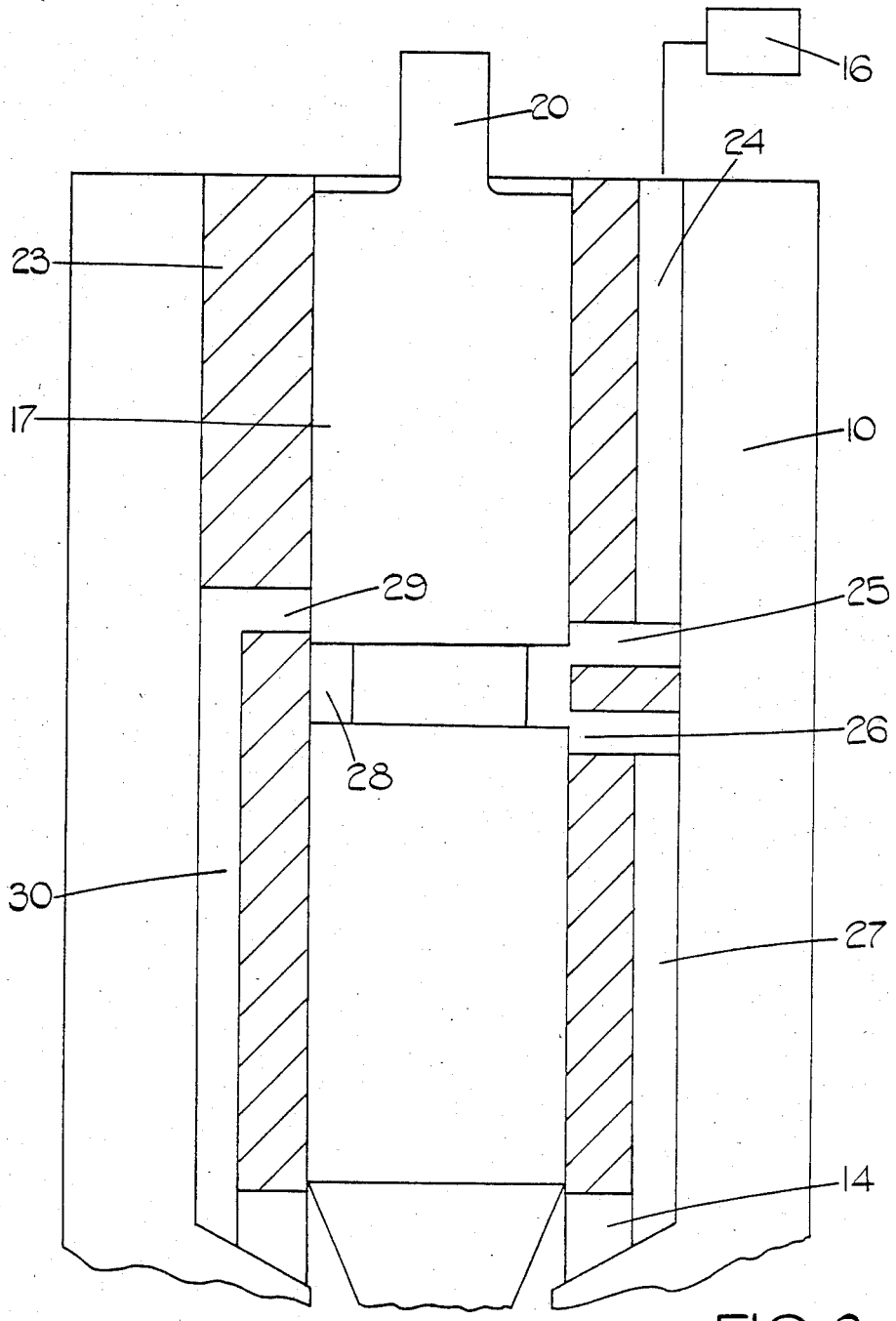

In the accompanying drawings:

FIG. 1 is a sectional side elevation of a known form of fuel injection nozzle, and FIG. 2 shows the modification necessary in accordance with the invention.

Referring to FIG. 1 of the drawings the nozzle comprises a body 10 of stepped form the narrower end of the body in use, being exposed within a combustion space of an associated engine. The nozzle body in practice, is secured to a support member or holder by means of a cap nut. Formed within the body is a blind bore 11 and this extends from the wider end of the body to adjacent the narrower end thereof. At the blind end of the bore there is defined a seating 12 about an outlet opening 13 and intermediate the ends of the bore the latter is provided with an enlargement 14 which communicates with a fuel inlet conveniently formed in the aforesaid holder, by way of an inlet passage 15. The passage 15 in use is connected to the outlet of a fuel injection pump 16.

Located within the bore is a valve member 17 which at its end adjacent the seating is shaped to co-operate therewith. The valve member also mounts an extension 18 which projects with clearance through the outlet opening 13. The portion of the valve member which is disposed between the enlargement and the blind end of the bore is of reduced diameter to define an annular clearance 19 which communicates with the enlargement 14 and hence with the inlet passage 15. At its end remote from the seating the valve member is provided with a peg 20 which carries a spring abutment 21, the latter being engaged by a coiled compression spring 22. The spring is mounted within a vented chamber defined in the aforesaid holder.

In operation, fuel under pressure supplied to the enlargement 14 from the fuel pump 16 acts on the differential area of the valve member to create a force which acts to move the valve member against the action of the spring 22. When the force exerted by the spring is overcome the valve member is lifted from its seating to allow fuel flow through the annular clearance defined between the extension 18 and the wall of the outlet opening 13. The extension is profiled to control the fuel flow through the opening and may be profiled to alter the shape of the fuel spray and/or the rate at which fuel can flow through the opening.

The pump 16 can be of any convenient type for example a reciprocating plunger type of pump in which each fuel injection nozzle is connected to a separate pump. The pump can however be of the rotary distributor type in which a single plunger or plungers by way of a rotary distributor member, deliver fuel to the injection nozzles in turn. The rate of fuel delivery and in particular the rate of pressure rise at the commencement of delivery of fuel can be very high particularly with a distributor type of pump and the practical effect is that the valve member lifts very quickly so that the extension is withdrawn very quickly from the outlet opening. It is therefore not able to provide adequate control or shaping of the fuel spray.

Turning now to FIG. 2, the valve member 17 is slidably mounted within a sleeve 23 which is located within the body, the sleeve 23 extending so far as the enlargement 14. The sleeve is a press fit within the body to ensure that once inserted it does not move during operation of the nozzle. The outlet of the pump 16 is connected to a longitudinal groove 24 formed in the exterior surface of the sleeve and which terminates in a port 25 opening onto the wall of the bore in the sleeve. At an axial position spaced from the port 25 in the direction of the seating, is a further port 26 which is connected by way of a further longitudinal groove 27 formed in the exterior surface and end surface of the sleeve, with the enlargement 14.

The valve member 17 is provided with a circumferential groove 28 which in the closed position of the valve member as shown in FIG. 2, effects restricted communication between the ports 25 and 26. The port 26 and the groove 27 constitute a first flow path and a second flow path is provided by a port 29 which opens into the wall of the bore in the sleeve and which communicates with the enlargement 14 by way of a further longitudinal groove 30 formed in the exterior surface and end surface of the sleeve. The port 29 is positioned so that in the closed position of the valve member the groove 28 is out of register therewith. The port 29 and the groove 30 constitute a second flow path.

In operation, when fuel under pressure is supplied by the injection pump, the fuel under pressure flows by way of the groove 24 and the port 25 to the groove 28 and from the groove 28 by way of the first flow path constituted by the port 26 and the groove 27 to the enlargement 14. The pressure in the enlargement therefore increases and at some point the force exerted by the spring is overcome so that the valve member is lifted from its seating. As the valve member lifts from its seating to allow fuel flow, the effective size of the port 26 is reduced and it offers an increasing restriction to the flow of fuel. The rise of pressure in the enlargement 14 is therefore controlled and the valve member does not suddenly open. As the pressure of fuel delivered by the fuel pump increases, the effective size of the port 26 decreases but before it is obturated, the groove 28 opens to the port 29 in other words, the second flow path is opened so that the pressure in the enlargement gradually increases and the valve member lifts in a controlled manner from its seating. As the valve member continues to lift from its seating flow of fuel through the first flow path will cease and the second flow path will convey the fuel by way of the port 25 and the groove 28, to the outlet. As the valve member continues to move away from its seating the degree of restriction offered by the port 29 will decrease since its effective size will increase and the valve member will lift quickly to its fully opened position.

I claim:

1. A fuel injection nozzle of the so-called inwardly opening type comnprising a nozzle body, a blind bore formed in the body, a seating defined at the blind end of the bore, a valve member slidable in the bore, one end of the valve member being shaped to co-operate with said seating, resilient means for biasing the valve member into contact with the seating, a fuel inlet in the body, said valve member defining an area against which fuel under pressure supplied to said inlet can act to lift the valve member away from the seating thereby to allow fuel flow through an outlet, first and second flow paths through which fuel flows from said inlet to act upon said area of the valve member and to said outlet, said first flow path including a restrictor the degree of restriction offered by the restrictor increasing as the valve member moves away from the seating, said second flow path being closed when the valve member is in contact with the seating but opening when the valve member has moved a predetermined distance away from the seating, said second flow path when opened, offering decreasing restriction to the flow of fuel as the valve member continues to move away from the seating.

2. A nozzle according to claim 1 including a groove formed in the valve member, said groove communicating with said inlet, a first port formed in the wall of the bore, said first port having restricted communication with said groove in the closed position of the valve member, said groove and said first port forming said first flow path, and a second port formed in the wall of said bore, said groove and said second port forming said second flow path.

3. A nozzle according to claim 2 including a further port in the wall of the bore said further port being in constant communication with said groove, said further port communicating with said inlet.

4. A nozzle according to claim 3 in which said bore and ports are defined in a sleeve which is a press fit within the nozzle body, the sleeve having longitudinal grooves in its exterior surface, the groove communicating with said ports respectively.

* * * * *